United States Patent [19]

Sander

[11] 3,953,983

[45] May 4, 1976

[54] REFRIGERATION METHOD AND REFRIGERATING APPARATUS FOR CARRYING OUT THE METHOD

[75] Inventor: Ernst Sander, Weissenburg, Germany

[73] Assignee: Friedrich Knopsmeier, Germany

[22] Filed: Apr. 8, 1974

[21] Appl. No.: 459,223

[30] Foreign Application Priority Data

Oct. 13, 1973 Germany ..... 2351516

[52] U.S. Cl. ..... 62/79; 62/143; 62/238; 62/332; 62/335; 62/175; 62/101

[51] Int. Cl.[2] ..... F25B 27/02

[58] Field of Search ..... 62/101, 143, 238, 332, 62/335, 79, 175

[56] References Cited

UNITED STATES PATENTS

| | | | |
|---|---|---|---|
| 1,904,991 | 4/1933 | Candor | 62/143 |
| 2,781,644 | 2/1957 | Saposnikov | 62/101 |
| 3,824,804 | 7/1974 | Sandmark | 62/332 X |

FOREIGN PATENTS OR APPLICATIONS

| | | | |
|---|---|---|---|
| 192,428 | 12/1956 | Austria | 62/335 |
| 953,378 | 11/1956 | Germany | 62/332 |

*Primary Examiner*—William F. O'Dea
*Assistant Examiner*—Peter D. Ferguson
*Attorney, Agent, or Firm*—Craig & Antonelli

[57] ABSTRACT

Refrigerating apparatus and method including a compressor refrigerating system and an absorber refrigerating system having respective separated closed circuits in operative relationship with respect to one another such that a coolant from the compressor system is usable for cooling a refrigerant of the absorber system. The compressor and absorber system are alternatingly operated to cool a common container with refrigerant store of the absorber system being replenished during operation of the compressor system by boiling out refrigerant from an absorber composition utilizing heat from coolant compressed and heated by a compressor of the compressor system.

27 Claims, 5 Drawing Figures

REFRIGERATION METHOD AND REFRIGERATING APPARATUS FOR CARRYING OUT THE METHOD

BACKGROUND AND SUMMARY OF THE INVENTION

The invention relates to a refrigeration method and apparatus employing a compressor refrigeration system and an absorber refrigeration system having separate closed circuits, the refrigerant of the compressor system being used for cooling a refrigerant of the absorber system.

Austrian Pat. Specification No. 192,428 and U.S. Pat. No. 2,781,644 disclose known refrigeration methods and apparatus. In one of these known methods, the compressor refrigerating system acts as an auxiliary refrigerating system which makes it possible to operate the absorber refrigeration system as a whole at a lower temperature level. For this purpose, not only is the condenser of the main refrigerating system cooled by an evaporator of the auxiliary refrigerating system but also a further evaporator, operated by the auxiliary refrigerating system, cools the absorber vessel. The temperature level of the absorber system can in this way be reduced sufficiently so that water at ambient temperature or air at ambient temperature can be used for boiling out the absorber composition. However, the cost of this system in terms of apparatus is relatively high; above all, it serves to allow the attainment of particularly low degrees of refrigeration. In the case of another known system, the evaporator of the compressor refrigerating system is located in the absorber vessel which is disposed downstream of the absorber refrigerating system evaporator. In consequence, it is intended to achieve temperatures down to −70° C.

An arrangement is also known (German Pat. Specification No. 1,215,181), which operates with a compressor refrigerating system and and absorber refrigerating system, the condenser of the compressor refrigerating system being within the evaporator of the absorber refrigerating system. In this case, the absorber system is used for cooling the compressor condenser. The compressor is in this case supplied by an electricity accumulator so that the entire arrangement can be rendered portable and independent of a fixed electric lighting system. The arrangement is to be used in conjunction with a transport container which has to be cooled, whereby, during transport, refrigeration is provided both by the absorber as well as by the compressor refrigerating system. The power required is drawn from the electricity accumulator. The use both of a compressor and also of an absorber system makes it possible to achieve particularly low temperatures. However, a disadvantage with this just-mentioned arrangement is that a power source is nevertheless required which, by virtue of its being constructed as an electricity accumulator, is bulky, very heavy and not very efficient. Also, the power density of an electricity accumulator is very low in relation to its volume as well as its weight.

In the case of a compressor refrigerating system, the power is supplied mechanically via the compressor drive. Usually provided as the compressor drive is an electric motor which draws its power from the mains. In the case of the absorber method, on the other hand, the power is supplied as thermal energy in that the absorber composition is heated, the refrigerating medium being thereby expelled. In this case, heating of the absorber composition and expulsion of the refrigerant on the one hand as well as recovery of the refrigerant when the absorber composition has cooled, on the other, can be effected continuously or in stages. However, a disadvantage of the absorber method is the relatively poor level of efficiency. Also, the number of combinations of materials which can be used as an absorber composition and as a refrigerant is very small. One very expedient combination of materials is for example lithium chloride as the absorber composition and methyl amine ($CH_3$-$NH_2$). Methyl amine has an evaporation heat of some 200 kg.cal/kg and lithium chloride has an absorption capacity of 2 kg methyl amine per kg of lithium chloride. At the conventionally attainable temperatures and pressures in the absorber system, it is necessary to heat the lithium chloride to approximately 200° C which gives rise to a relatively violent gas, so that the spongy-porous structure of the lithium chloride is rapidly destroyed. A relatively high temperature and thus a high pressure is however required in this zone of the system, because in the condenser, for liquefaction, it is generally not possible to cool down farther than approximately ambient temperature. At this relatively high temperature, however, it is essential to go below the boiling point, which is possible only by relatively high pressure. A disadvantage of the compressor method system is that a mechanical driving energy is required which can only be produced easily and conveniently if an electricity supply mains (high quantity electrical energy source) is available. However, if such a mains supply is not available, then the only driving possibility is a cumbersome, expensive and extremely noisy internal combustion engine. Refrigerated transport containers in which heat-sensitive goods such as for example easily spoiled foodstuffs, are transported, are provided with their own refrigerating plant which derives its power either from its own internal combustion engine or from the driving engine of the vehicle. These refrigerating plants are generally constructed as compressor systems.

An object of the present invention is to provide a refrigeration method which achieves satisfactory efficiency and with which it is possible to manage, at least for a time, without an external power supply, so that it is particularly suitable for the refrigeration of transporter tanks.

The present invention contemplates overcoming the above-mentioned disadvantages of previous systems by providing that the compressor refrigerating system and the absorber refrigerating system are alternatingly in operation and the refrigerant store of the absorber system during the period of operation of the compressor system is made up again by boiling out the absorber composition and that for this boiling out the coolant compressed and therefore heated by the compressor is used.

The advantage of a so combined system in accordance with the present invention lies in the extremely improved efficiency since the heat getting free during cooling of the coolant is used for boiling out the refrigerant from the absorber composition. By cooling the refrigerant of the absorber system by means of the coolant of the compressor system a favorable temperature-pressure-level in the absorber system is achieved. This system is especially suitable for the cooling of containers; yet by virtue of its improved level of efficiency it is also quite suitable for a stationary refrigeration wherein the advantages of the method according to the invention also become effective. Since a large part of the energy supplied to the compressor system in the form of heat is getting lost unused, this heat, however, being utilized by the inventive method, it is possible to considerably reduce the costs for energy during operation of a system according to the invention. Moreover, the absence of electric current will not cause damages to the goods to be cooled, since during the period of the absence of current or power supply failure the absorber system can take over the refrigeration.

The method according to the invention is preferably applied for the cooling of containers. Thereby, the compressor system operates during the transporting pauses and during the transport the absorber system operating without power supply and being fed from a refrigerant store is in operation, the refrigerant store of the absorber system being made up again during the transport pauses by boiling out the absorber composition.

A particular advantage of the combined method according to the invention resides in that the compressor refrigeration system can be operated during periods when a suitable power source, for example the public electricity supply mains, is available. During this time, the absorber refrigeration system is "charged." The absorber system can then perform its function for a definite time during which, for want of a suitable power source, the compressor refrigerating system cannot operate. A further advantage of the system lies in the fact that, due to the use of the compressor system for cooling the refrigerant of the absorber system, the operating points of the absorber system can be so located that on the one hand the absorber system acquires an improved level of efficiency because its working temperature differential can be widened and because, on the other hand, by virtue of the displaced working point, a substantially reduced loading on the absorber material is achieved, so that the absorber material has a long effective life and hitherto unsatisfactory absorber materials can be reliably utilized.

For cooling the refrigerant of the absorber system, it is possible for example to use the liquid refrigerating medium of the compressor system or, as is preferable, the gaseous coolant leaving the evaporator of the compressor system can be used for cooling the refrigerant. Thus, the refrigerating capacity of the refrigerant of the compressor system such as it still has after leaving the evaporator, can be used for further cooling of the refrigerant of the absorber system.

The refrigerant can be cooled in various ways. In one preferred method according to the invention, refrigerating medium supplied in gaseous form to a condenser from an absorber vessel provided with absorber composition is subsequently passed through a heat exchanger to a liquid refrigerant collector whereby, in order to cool the refrigerant, gaseous refrigerating medium flowing from the evaporator to the compressor flows through the heat exchanger. In this embodiment, the "used gas" of the compressor system, which has already fulfilled its function of cooling a space, is utilized in order to extract still more heat from the refrigerating medium. In preferred embodiments where the resultant cooling effect is not sufficiently pronounced, it is contemplated by the invention to provide that liquid refrigerating medium be fed to the heat exchanger, bypassing the evaporator, evaporation being undertaken in the heat exchanger. In consequence, a very pronounced refrigerating effect can be achieved. However, it is also contemplated by the invention to use both already evaporated coolant coming from the evaporator of the compressor system as well as liquid coolant derived from the feed to the evaporator of the compressor system, in order to extract sufficient heat from the refrigerating medium in the heat exchanger.

The refrigerating medium of the absorber system rendered liquid and further cooled in the heat exchanger is collected in a collecting vessel from which it can be extracted for the purpose of cooling. Thus, the collecting vessel serves as a refrigerant store which is thermally well-insulated in order to avoid cooling losses. In order, upon prolonged storage of the refrigerating medium, to avoid an undesired rise in the temperature in the collecting vessel, a preferred form of implementation of the method of the invention provides for the refrigerating medium of the compressor system which leaves the heat exchanger to be fed through a cooling coil of the collecting vessel for the refrigerating medium of the absorber system. It will be appreciated that the cooling coil can also be directly connected to the line leading to the evaporator, so that liquid refrigerating medium would be supplied to the cooling coil through a correspondingly dimensioned throttle and vaporize in the cooling coil. Generally, however, it is sufficient to supply to the cooling coil "used gas" from the heat exchanger in order to dissipate again the heat inevitably penetrating the collecting vessel even through good insulation.

In order to "boil out" the absorber composition, the heat from an additional heat source may be used. However, in the case of a particularly preferred embodiment of the invention, the heat of the refrigerating medium compressed by the compressor is utilized for "boiling out" the absorber composition. This procedure has the advantage of substantially enhancing the efficiency of the installation because the heat contained in the compressed refrigerating medium is not uselessly imparted to the ambient but is utilized in order to heat the absorber composition. It will be understood that if the quantity of heat supplied by the compressed refrigerating medium is not sufficient, an auxiliary heat source is used. Once the compressed refrigerating medium has given off a substantial part of its heat to the absorber composition, the refrigerating medium having in consequence been expelled from the absorber composition, the refrigerating medium can in known manner be further cooled and liquefied by a condenser, unless liquefaction has already taken place during heating of the absorber composition.

In the case of a preferred further development of the method according to the invention, prior to commencement of transport, the absorber composition is cooled in the absorber vessel and, to this end, either liquid refrigerating medium is supplied, bypassing an evaporator of the compressor refrigerating system and evaporation is effected in the absorber vessel or gaseous and still relatively cold refrigerating medium leaving the compressor refrigerating system is supplied. The particular advantage hereby resides in the fact that at the commencement of transport the absorber refrigerating system is at once fully capable of functioning. The ability of the absorber composition to accommodate refrigerating medium is greatly dependent upon temperature, which is why the absorber vessel is also heated in order to expel the refrigerating medium from the absorber compostion. Prior to commencement of transport, cooling of the absorber composition makes the full refrigerating efficiency immediately available. Particularly advantageous is the form of the method according to the invention, wherein the gaseous refrigerating medium leaving the evaporator of the compressor refrigerating system is used for such cooling of the absorber composition. This gaseous refrigerating medium, when it leaves the evaporator, is at a temperature below the temperature obtained in the transport container or is at most equal to this temperature. This temperature, generally of considerable minus degrees, is sufficient adequately to cool the absorber composition in the absorber vessel.

The compressor refrigerating system and the absorber refrigerating system are operated with different substances. Preferably, the compressor refrigerating system is operated on a compound which is commercially available as Frigen. Also various combinations of substances are suitable for the absorber refrigerating system.

Methyl amine is the preferred refrigerating medium while lithium chloride is preferably used as the absorber composition.

In the case of a further development of the method according to the invention the absorber composition is additionally cooled in an absorber vessel during the operation of the absorber. By additional cooling through cooling liquid during the absorption, the absorber composition is maintained at a low temperature, so that the pressure level in the absorber circuit may be kept low, thus leading to an improved efficiency of the absorber system. The invention further contemplates providing embodiments where the refrigeration is entirely or partly designed as surface refrigeration of the absorber vessel and the cooling liquid is subsequently watched for a refrigerant contained therein so that it is always immediately ascertainable if a leak occurs in the absorber system. In this way it is possible to prevent that poisonous refrigerants of the absorber system will reach the waste-water canalization together with the cooling liquid.

The invention furthermore relates to an apparatus for economically implementing the above-described method. The present invention contemplates refrigerating apparatus which is provided with a compressor with a drive for compressing a gaseous refrigerating medium with, on the downstream side, a condenser for liquefying the refrigerating medium, from which a line leads to a pressure relieving throttle disposed in a space which is to be cooled and which has adjacent to it an evaporator from which a return line leads to the vacuum connection of the compressor. The apparatus further includes an absorber refrigerating system containing a refrigerating medium and provided with an absorber composition in an absorber vessel from which a gas line leads to an absorber condenser, whence a line leads to a liquid refrigerant collecting vessel, connected to which there is, disposed in the space to be refrigerated, a pressure relieving element with an adjacent evaporator, the return line from which discharges into the absorber vessel.

A refrigerating apparatus is generally known (DAS1,215,181) utilizing both compressor and absorber systems. As already discussed above, a disadvantage of this prior apparatus is that the absorber refrigerating system serves only to cool the compressor condenser while the compressor is supplied by an electricity accumulator in order to render the entire arrangement portable and independent of the electric lighting system. The carrying of electric power makes the arrangement bulky, very heavy and not very efficient.

An object of the present invention further resides in the provision of a refrigerating apparatus for carrying out the method according to the invention and which differs by special features and advantageously from the known refrigerating apparatus. On the basis of a refrigerating apparatus of the type described at the outset, this problem is, according to the invention, resolved in that between the absorber condenser and the liquid refrigerant collector there is a heat exchanger preceding the vacuum (or low pressure side) connection of the compressor so that for cooling the refrigerant of the absorber system flowing through the apparatus, refrigerating medium of the compressor system flows through the heat exchanger.

One advantage of the refrigerating apparatus according to the invention resides in the fact that satisfactory efficiency is achieved and that the two refrigerating circuits can be operated individually or jointly, as desired. A particular advantage of this refrigerating apparatus which makes it pre-eminently suited for refrigerating transport containers, lies in the fact that it can operate for certain periods of time to generate cooling of a space without the supply of mechanical or electrical power. A further advantage of the apparatus according to the invention lies in the fact that the absorber system can be designed in a way which not only provides for greater efficiency of this system but also opens up an opportunity for the use of combinations of materials which hitherto not readily usable for the absorber composition and the refrigerating medium. So long as mechanical or electrical energy is available, the space to be cooled is cooled by the compressor system; at the same time, the absorber system is being "charged," so that the absorber system can take over the work of cooling during those periods when the compressor system cannot be utilized for want of driving power. As a result, refrigerating chambers or transporters containers which are fitted with refrigerating equipment according to the invention can be kept permanently cool. For example, it is possible in this way to avoid the temperature in a stationary refrigerating chamber rising excessively on power mains failure and also to ensure that portable refrigerating chambers remain cooled in transit or need not be provided with a combustion engine to drive the compressor refrigerating system, which would be uneconomical and expensive and which would moreover entail disturbance, noise and smell.

In a preferred embodiment of the invention, a cooling coil is disposed between the heat exchanger and the suction connection of the compressor in a vessel for collecting liquid refrigerant of the absorber system. As a result, the refrigerant present in the collecting vessel retains the lower temperature achieved and, despite the heat insulation provided, does not become undesirably heated. It will be appreciated that this cooling coil can also be incorporated upstream of the heat exchanger, in other words between the compressor system evaporator and the heat exchanger.

The cooling medium feed connection of the heat exchanger is made in various ways in accordance with various preferred embodiments of the present invention. In one preferred embodiment of the invention, the feed connection is made downstream of the outlet from the evaporator of the compressor system. In this embodiment, it is the "used gas" flowing to the compressor from the evaporator disposed in the space which is to be refrigerated which is used for cooling the refrigerant of the absorber system.

With other embodiments of the invention, on the other hand, a feed connection of the heat exchanger for refrigerant is made to the outlet side of a pressure relieving element, to which liquid refrigerating medium for the compressor system is supplied so that the heat exchanger serves as an evaporator for the refrigerating medium. This embodiment is used when a very marked cooling of the refrigerating medium of the absorber system is required and the gaseous refrigerant leaving the evaporator of the compressor system cannot generate an adequate cooling effect. The heat exchanger is preferably avoided with two feed connections for the refrigerating medium which can be used simultaneously or optionally. In other preferred arrangements, the heat exchanger is provided with only one such feed connection, the supply line of which can be changed over as required. In a further development, a constant or intermittent change over can be provided for the heat exchanger feed, controlled preferably by a thermostat. By virtue of this reversibility, according to the refrigerating output desired or according to the given ambient conditions, the desired operating pattern of the apparatus can be achieved.

The thermostat can be controlled as a function of various factors. In the case of preferred embodiments of the invention, the thermostat is sensitive to the temperature of the coolant (of the compressor systems) emerging from the heat exchanger or of the refrigerant (of the absorber system) emerging or the temperature of the refrigerant in the collector which becomes the controlled variable. According to the choice of the controlled variable, so the feed to the heat exchanger can be variously controlled.

In a further development of the present invention, a non-return valve is incorporated into the line between the absorber vessel and the absorber condenser to prevent refrigerant flowing in the direction of the absorber vessel.

The efficiency of the known refrigerating apparatuses is relatively low. A considerable improvement of the already satisfactory efficiency of the apparatus according to the invention is, in the case of a particularly preferred embodiment, achieved in that a condenser provided downstream of the pressure connection of the compressor is provided and is constructed as a heat source for the absorber vessel. The compressed coolant leaving the compressor in a gaseous form is heated by the compression process. This heat is usually given off to the ambient air in a subsequent condenser. In the case of the refrigerating apparatus according to the invention, however, this heat is not uselessly dissipated to the ambient air but is used to heat the absorber composition in the absorber vessel. Condensation of the coolant can then take place within the absorber vessel. However, if the temperature of the coolant, when leaving the absorber vessel, is still above boiling point, then a conventional condenser is provided on the downstream side to extract the residual heat from the coolant and discharge it into the air passing by under the stimulus of a fan. The heating condenser which serves as a heat source can be provided instead of or in addition to a conventional heat source. In a preferred form of embodiment of the invention, the heating condenser is constructed as a heat exchanger built into the absorber vessel. Likewise, the heating condenser could also be constructed as a heating coil surrounding the absorber vessel.

In a preferred embodiment of the invention, the absorber composition is held in the absorber vessel on filters disposed one above another and a heat exchanger built into the absorber vessel is constructed as a central spiral tube which is extended through the annular filters. In this embodiment, the filters are preferably mechanically connected both to the spiral tube and also to the outside wall of the absorber vessel in a readily heat-conductive manner. Location of the absorber composition on filters ensures a good long-term activity for the absorber composition, because the active surface of the absorber composition is very large. The absorber composition in each layer is easily accessible to the gaseous refrigerating medium both from above and also, by virtue of the filter structure, from below. The readily heat-conductive connection of the filters to the spiral tube can ensure rapid supply or dissipation of heat.

In a preferred further embodiment of the invention, the spiral tube is incorporated between the pressure connection of the compressor and the condenser of the compressor refrigerating system or between the condenser of the compressor refrigerating system and/or the evaporator of the compressor refrigerating system and the suction connection of the compressor. Therefore, in the case of such an apparatus, the spiral tube is usable for boiling out and thus for expelling the refrigerant during pauses in transport, utilizing the waste heat from the compressor which must in any event be dispersed. In addition, the spiral tube is also usable for cooling the absorber composition prior to commencement of transport, in order to cool the absorber vessel with the absorber composition by using excess refrigerating output from the compressor system and thus ensure full efficiency of the absorber system from the time transport commences. Generally, long prior to commencement of transport, the container to be cooled is cooled to such an extent that the compressor refrigerating system only needs to cover refrigerating losses and therefore its full efficiency is no longer required. This excess performance can be utilized to cool the absorber vessel with the absorber composition.

If the spiral tube is used both for heating and also for cooling the absorber vessel, then by reason of the differing conditions, the heating or cooling efficiency may be too low or too high. In a further preferred embodiment of the invention, therefore, the spiral tube is used only for heating the absorber vessel and incorporated into the absorber vessel is a cooling coil which can be incorporated between the suction connection of the compressor and the evaporator of the compressor refrigerating system or the condenser of the compressor refrigerating system. The cooling coil can thereby switched on and off via a controlled valve, for example a time-dependently controlled valve. In preferred embodiments of the invention, a multi-way valve is provided to switch over the heating or cooling circuits of the absorber vessel and the multi-way valve or valves can be switched over as a function of time according to the pressure obtaining in the absorber vessel.

In the absorber vessel, as already mentioned, the absorber composition is held on filters in order to achieve a large active surface and in order to ensure a rapid exchange of refrigerating medium. In order also to achieve rapid heating of the absorber composition, in a preferred embodiment of the invention, the filters are connected in a readily heat-conductive manner to the spiral tube; furthermore, the filters are mounted on a central carrier so that they can be removed from and replaced in the absorber vessel together with the carrier and the absorber composition. This embodiment of the invention not only provides for rapid heating of the absorber composition and thus rapid expulsion of the refrigerant; in addition, the fact that the carrier, filters and also preferably the spiral tube are constructed as one unit means that the absorber composition can be rapidly and easily replaced when necessary.

In a preferred further development of the present invention, a refrigerating or cooling apparatus is additionally incorporated and the filters are connected thereto in a readily heat-conductive manner. In the case of this embodiment, both the heating coil as well as the refrigerating apparatus can always be adapted in optimum fashion to the working conditions, and, on the one hand, a rapid but nevertheless gentle boiling out of the absorber composition is achieved and also, as prior to commencement of transport the absorber composition can be cooled in a minimum of time. As a result, even with short operating times, recharging of the absorber circuit can be achieved and rapid readiness for operation at full efficiency of the absorber circuit can be attained at the commencement of the next transport stage. The advantages of the refrigerating method according to the invention and of the refrigerating apparatus according to the invention are experienced particularly when they are applied to a transportable refrigerating container. In the case of a preferred embodiment, therefore, a refrigerating apparatus according to the invention is combined with a transportable refrigerating container, the compressor refrigerating part operating during pauses in transport and charging the absorber refrigerating part, the absorber refrigerating part taking over the refrigeration during transport. During pauses in transport, the compressor refrigerating part cools the refrigerating container or maintains it in a cold state and also the collecting vessel is filled with refrigerant and if necessary also the absorber vessel is cooled prior to commencement of transport. In this case, the compressor refrigerating part is designed according to the length of the anticipated pauses in transport, in terms of its efficiency, to ensure that, at all times, there is an adequate quantity of refrigerant for the period of transport present in liquid form in the collecting vessel, and to ensure moreover that the temperature in the refrigerating container never exceeds the limit value required.

In the case of a preferred embodiment of a refrigerating apparatus the absorber vessel is provided with additional cooling device being connected to a cooling liquid store. With the additional refrigeration not only the absorption process is favorably influenced and the maintenance of a low pressure level is made possible, but also the efficiency of the absorber system will be improved. Thereby, a circuit is preferably provided for the cooling liquid.

These and further objects, features and advantages of the present invention will become more obvious from the following description when taken in connection with the accompanying drawings which show, for purposes of illustration only, several embodiments in accordance with the present invention.

DETAILED DESCRIPTION OF THE DRAWINGS

Figure 1:
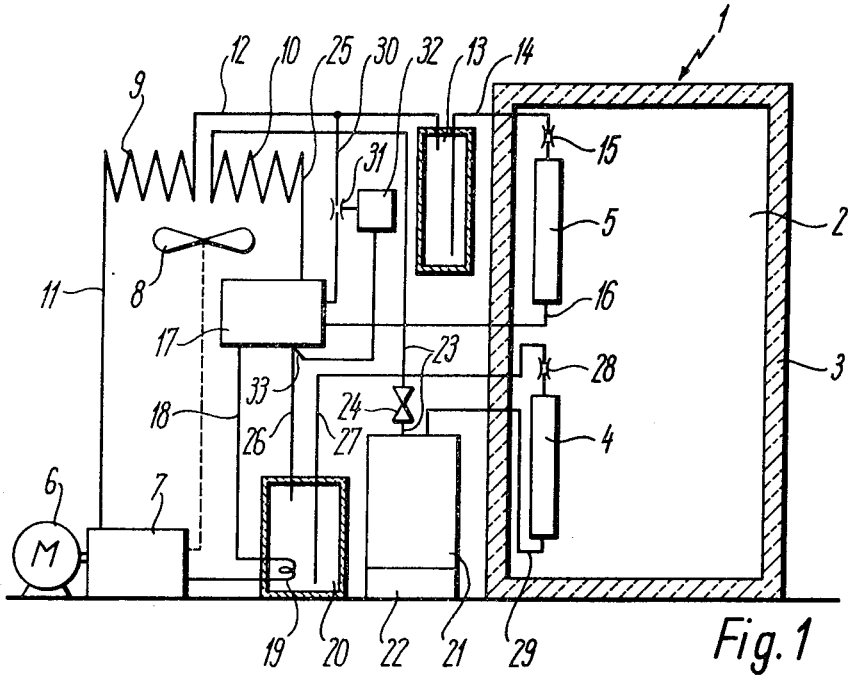
FIGS. 1 and 2 are block layout diagrams of two different embodiments arranged according to the invention.

In the various views, like reference numerals are used to depict like structures.

A refrigerating container 1 with an inner space 2 which is to be maintained cold is provided with a heat insulation 3 enclosing the space 2 on all sides. The refrigerating container 1 is constructed as a transportable unit together with a compressor refrigerating system and an absorber refrigerating system. Such refrigerating containers serve preferably for conveying deep-frozen foodstuffs from the manufacturers, where the foodstuffs are frozen, to the distributor or to the consumer. Under such conditions, it is important to ensure that the temperature of the deep-frozen foodstuffs never rises above a definite limit.

In order to maintain the space 2 below this limit temperature, it is provided with an evaporator 4 of an absorber refrigerating system and an evaporator 5 of a compressor refrigerating system.

The compressor refrigerating system comprises a drive motor 6 which drives a compressor 7. Mechanically connected to the compressor or the motor shaft is a fan blade 8 which co-rotates when the compressor is running and passes cooling air to two condensers 9 and 10. The compressor circuit is associated with the condenser 9 and the absorber circuit is associated with the condenser 10. On the feed side, the condenser 9 is connected via a feed line 11 to the pressure connection of the compressor 7 whereas, on the outlet side, it is connected via a condensate line 12 to a collecting vessel 13 for coolant which is constructed as a pressure container. From the collecting vessel 13, a pressure line 14 extends through the heat insulation 3 into the space 2 to a throttle 15 which precedes the evaporator 5. From the evaporator 5, a discharge line 16 extends through the heat insulation 3 outwardly to a heat exchanger 17. From the heat exchanger 17, a return line 18 leads to a cooling coil 19 and onto the suction connection of the compressor 7. The cooling coil 19 is disposed in a collecting vessel 20 for refrigerant; the collecting vessel 20 is constructed as a storage container which is well heat-insulated.

Provided in an absorber vessel 21 which is equipped with a heating means 22, there is an absorber composition, preferably lithium chloride which has absorbed methyl amine which serves as the refrigerant and which it gives off by virtue of the action of heat from the heating device 22. Connected to the absorber vessel 21 is a gas line 23 in which a non-return valve 24 is incorporated which opens only in the direction leading away from the absorber vessel 21. The gas line 23 through which gaseous refrigerant flows when the heating device 22 is in operation, leads to the feed side of the condenser 10. The discharge side of the condenser 10 is connected through a line 25 to the heat exchanger 17 from which a condensate line 26 leads to the collecting vessel 20. From the collecting vessel 20, a riser pipe 27 extends through the heat insulation 3 into the cooling space 2 to a throttle 28 which serves as a pressure relieving element. The throttle 28 precedes the evaporator 4 from which a steam line 29 extends outwardly and back to the absorber vessel 21.

During periods when electric power is available, the compressor 7 is driven. It compresses coolant which is cooled to below boiling point in the condenser 9 so that it condenses. The condensate flows into the coolant collector 13. From there it flows on through the pressure line 14 and its pressure is relieved in the throttle 15. Thus, a greatly diminished pressure is obtained in an evaporator provided downstream of the throttle 15, so that the boiling point is lowered and the condensate evaporates in an evaporator 5, whereby it draws from the space 2 a quantity of heat corresponding to its evaporation heat and thus cools the space 2. The vaporous coolant then flows through the discharge line 16 to the heat exchanger 17, flows through this exchanger 17 and finally flows back through the cooling coil 19 to the suction connection of the compressor 7.

During this period of operation of the compressor, the absorber system is also "charged." The heating apparatus 22 operates and heats the absorber composition in the absorber vessel 21 from which the absorber refrigerant emerges in gaseous form. The absorber refrigerant flows through the gas line 23, through the condenser 10 which likewise receives cooling air from the fan 8. The absorber refrigerant then flows on through the line 25 to the heat exchanger 17. The absorber refrigerant is either liquefied already in the condenser 10 or in the heat exchanger 17 due to the drop in temperature. The absorber refrigerant-condensate flows through the condensate line 26 into the well heat-insulated collector 20 in which the condensate is maintained at the desired low temperature by the cooling coil 19. This process is carried out until such time as the absorber composition in the absorber vessel 21 has given off sufficient gas and a sufficient quantity of absorber refrigerant is stored in the collecting vessel 20.

If the power supply then fails or if the refrigerating apparatus is transported together with the refrigerating container, in which case no driving power for the compressor 7 is available, then the liquid absorber refrigerant is fed through the riser pipe 27 via the throttle 28 to the evaporator 4. The pressure is thereby reduced sufficiently that the temperature falls below the boiling point and heat is drawn from the space 2 by evaporation of the absorber refrigerant, so that space 2 can be maintained at the desired temperature. The evaporated absorber refrigerant is fed back through the vapor line 29 to the absorber vessel 21 where the absorber refrigerant is absorbed by the absorber composition. During this time, the heating device 22 is inoperative.

In cases where rapid storage of absorber refrigerant in the collecting vessel 20 is desired or in which the evaporated coolant which is fed to the heat exchanger 17 through the line 16 does not have adequate cooling capacity, compressor system condensate is drawn from the condensate line 12 or the collecting vessel 13 through a subsidiary line 30. This compressor system condensate flows through a throttle 31 incorporated into the subsidiary line 30 and to the heat exchanger 17. There, the compressor system condensate evaporates and the considerable quantity of heat which it absorbs in the process cools the absorber refrigerant flowing through the heat exchanger 17 to the desired extent. The evaporated compressor system condensate which is now coolant then flows through the return line 18 and the cooling coil 19 back to the suction connection of the compressor 7.

The throttle 31 is preferably controlled by a thermostat 32 which has a temperature sensor 33 which is preferably sensitive to the absorber refrigerant outlet temperature of the heat exchanger 17. In other preferred embodiments, the temperature sensor 33 is sensitive to the outlet temperature of compressor system coolant from the heat exchanger 17 or the inlet temperature in the line 16 or even the temperature of the refrigerant stored in the collecting vessel 20.

It will be understood that the present invention is not limited to the very diagrammatically shown example of embodiments illustrated (the FIG. 1 embodiment being described above) but that modifications can be made without departing from the framework of the invention. In particular, individual of the features of the invention may be used by themselves or in a plurality of combinations. It will also be appreciated that the usual regulating devices for maintaining the desired temperature limits in the space 2 are provided in conventional manner. However, for the sake of simplicity of illustration, these regulating devices have been omitted since one skilled in the art given the present disclosure would be able to construct and operate embodiments of the invention.

These non-illustrated regulating devices include a thermostat sensitive to the temperature in the space 2 for controlling an on and off switch for compressor 7 according to a preferred embodiment. This thermostat controls positioning valves connected upstream of the throttles 15 or 28 and which therefore control the throughflow of condensate and thus the cooling output according to other preferred embodiments. In this last-mentioned case, it is expedient for the compressor 7 to be switched off by level switches which sense the level of coolant in the collecting vessel 13 or level of refrigerant in the collecting vessel 20. Furthermore, a magnetic valve in the riser pipe 27 is preferably provided to ensure that, so long as the compressor 7 is operating, the riser pipe 27 is always closed but can be opened as a function of the temperature in the space 2, when the compressor 7 is not driven. As a result of the level switches in the collector vessels 20 and 13, the compressor 7 can run until such time as an adequate quantity of condensate is available. Then, if the temperature in the space 2 is at the same time sufficiently low, the compressor 7 is switched off. For the compressor 7 to be switched on, it is sufficient if either the thermostat senses too high a temperature in the space 2 or if the level switch in the collecting vessel 20 indicates too low a level. On the other hand, for the compressor 7 to be switched off, both conditions must be satisfied: there must be adequate condensate in the collecting vessel 20 and a sufficiently low temperature must have been reached in the space 2. If the thermostat shuts down the valve in the pressure line 14 while the compressor 7 is running, then the throttle 31 automatically opens because the temperature 33 of the thermostat 32 indicates a rising temperature which is based on the fact that no refrigerating medium is any longer being supplied through the discharge line 16.

Figure 2:
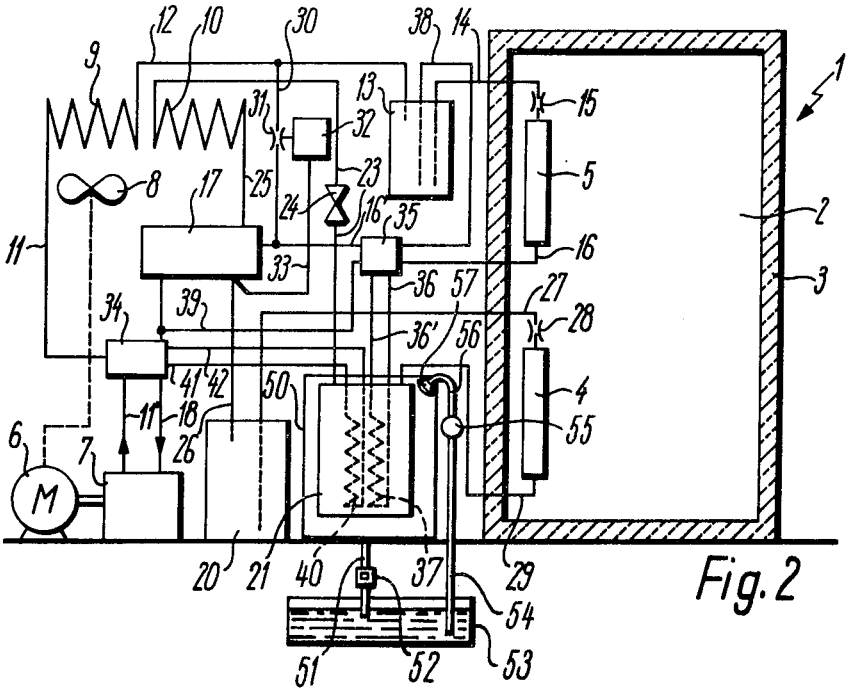

In the case of the embodiment of the invention shown in FIG. 2, two multi-way valves 34 and 35 are provided. The multi-way valve 34 is connected through a feed line 11' to the pressure connection of the compressor 7 and through the feed line 11 to the condenser 9. Moreover, the multi-way valve 34 is connected through a feed 41 and a return 42 to a tubular heating filament 40 housed in the absorber vessel 21 (see FIGS. 3 and 4 for details of absorber vessel embodiments). The multi-way valve 34 is so constructed that in one position the feed line 11' is connected to the feed line 11 the conduit is connected with the conduit 39, and the conduit 18 is connected with the conduit 42; while in the other position the feed line 11' is connected to the feed 41, the supply conduit 11' is connected with the conduit 42, and the return 42 is connected to the feed line 11. Therefore, it is possible as desired to feed the coolant compressed by the compressor and heated directly to the condenser 9 or through the spiral tube 40 to the condenser 9. Thus, the waste heat from the compressor is used for heating and boiling out the absorber composition.

The mullti-way valve 35 has on the other hand five switch positions. In a first position, valve 35 connects the discharge line 16 from the evaporator 5 of the compressor refrigerating system to a discharge line 16' which leads to the heat exchanger 17. In a second position, valve 35 connects the discharge line 16 to a cooling feed line 36 which leads to a cooling coil 37. At the same time, the cooling discharge line 36' from the cooling coil 37 is connected to the discharge line 16'. In a third position, the discharge line 16 is in turn connected to the cooling feed line 36 but the refrigerant discharge line 36' is connected to a line 39 which leads to the return line 18. In a fourth position, a supply line 38 which leads from the collecting vessel 13 to the multi-way valve 35, is connected to the cooling feed line 36 and the cooling discharge line 36' is connected to the discharge line 16'. Finally, in a fifth position, the supply line 38 is likewise connected to the cooling feed line 36 but the cooling discharge line 36' on the other hand is connected to the line 39.

By appropriately selecting the positions of the multi-way valve 35, it is possible according to the invention to establish a system of operation which satisfies all conditions. It is possible as desired to feed the residual coldness of the coolant emanating from the evaporator 5 both directly to the heat exchanger 17 as well as through an interposed cooling coil 37. Similarly, coolant can be fed directly from the collecting vessel 13 to the heat exchanger 17, where its pressure is relieved. Also, the coolant can be fed from the collecting vessel 13 through the interposed cooling coil 37 to the heat exchanger 17, a pressure relieving throttle being associated with the cooling coil 37. In addition to regulating devices as described above for the FIG. 1 embodiment it will be understood that the FIG. 2 embodiment includes regulating devices for controlling each of the control valves 34 and 35. Since one skilled in the art, given the present disclosure, will be readily able to construct regulating devices for valves 34 and 35 to effect the described desired operating conditions, details of such regulating devices are not included herein.

Figure 3:
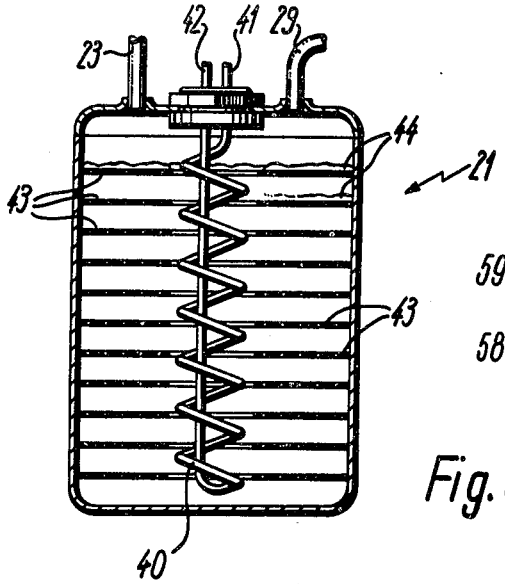
FIGS. 3 and 4 are cross-sectional schematic views of two different embodiments of absorber vessels constructed according to the invention.

The absorber vessel 21 shown diagrammatically in longitudinal section in FIG. 3 is provided with a central tubular spiral 40, the feed 41 of which extends alongside its return 42, feed 41 and return 42 being carried to the multi-way valve 34. In addition to steam line 29, also the gas line 23 into which the non-return valve 24 is incorporated, discharge into the container. Disposed in the absorber vessel 21 are a series of annular filters 43 which consist of fine-mesh wire gauze, the outer edges of these being attached to the housing of the absorber 21. Their inner edges are connected in readily heat-conductive manner to the spiral tube 40. If the filters themselves are not sufficiently stable mechanically, then appropriate support arms not shown in the drawing are provided on the spiral tube and the filters are mounted on these. Placed in thin layers on the filters 43 is absorber composition 44 which is thus readily accessible to gaseous refrigerant both from above as well from below. A separate cooling coil 37 is also provided in the vessel 21 (schematically shown in FIG. 2, not shown in FIG. 3).

In the case of an embodiment of the invention, not shown, in which the spiral tube 40 can be used for heating and for cooling, connected to the feed 41 and the return 42 is a multi-way valve through which the spiral tube 40 can be connected both into the feed line 11 or into the discharge line 16 or the return line 18. When the spiral tube 40 is connected into the line 11, it is traversed by the coolant heated by the compressor 7, effecting heating and boiling-out of the absorber composition 44. Thus, heat is drawn from the coolant in the desired manner so that the condenser 9 is relieved or a more rapid liquefaction of the coolant is achieved. On the other hand, as is always effected prior to commencement of transport, if the spiral tube 40 is connected by the multi-way valve into the discharge line 16 or the return line 18, then the absorber composition 44 is cooled and is thus brought, already at commencement of absorber cooling, to a temperature favorable for the efficiency of the absorber refrigerating system.

Figure 4:
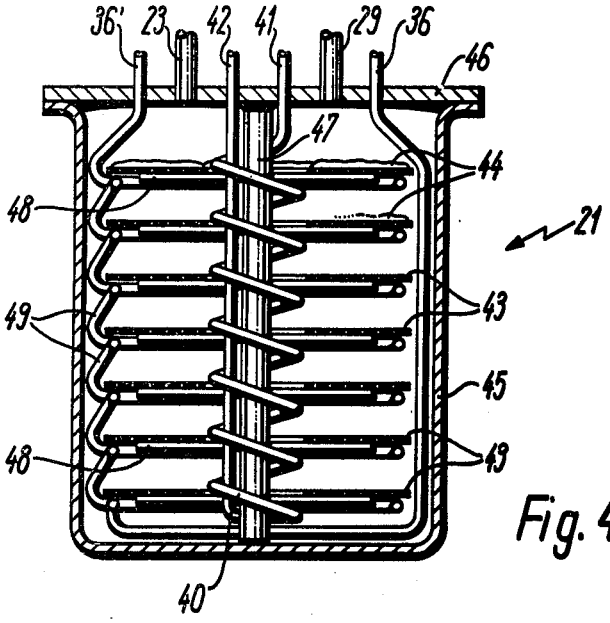

The absorber vessel 21' shown in FIG. 4 comprises not only the heat-insulated pot-shaped vessel 45 but also a cover 46 mounted on a flange on the vessel. Attached to the cover 46 is a carrier 47 which extends in the direction of the longitudinal central axis of the vessel 45 approximately to the bottom of the vessel. Integrally moulded on the carrier 47 are radial arms 48 onto which the filters 43' are placed and secured. The absorber composition 44 is shaken loosely onto the filters 43' which, in plan view, take the form of annular discs. The heating coil 40' is mounted on the cover 46 and is looped around the carrier 47. It is in good thermal contact with the filters 43'. In addition, the refrigerant supply line 36 and refrigerant discharge line 36' extend through the cover 46. Both these pipes lead to a system of tubes which in each case comprises a tubular loop which is in good thermal contact in each case with a filter 43' and, which is connected through a connecting tube 49 to the tubular loop of the next filter level on the next arm 48. The advantage of this construction resides in the fact that the entire unit can be removed as a whole from the vessel together with cover 46 so that it is readily accessible, for example for inspecting the nature of the absorber composition 44 which can then be exchanged if necessary. The just-mentioned tubes and loops for cooling form the schematically depicted cooling coil 37 of FIG. 3.

The absorber vessel 21, 21' is arranged within a protection vessel 50 which is thermally well insulating, through which the different outlets and feed lines to the absorber vessel are conducted and which entirely surrounds the absorber vessel. To the bottom portion of the protection vessel 50 an outflow 51 is connected, the flow of which is conducted through an indicator 52. The outflow 51 leads further to a cooling liquid collecting vessel 53. Into the cooling liquid collecting vessel 53 an immersion tube 54 is dipped which leads to a feed pump 55 to the pressure side of which a feed pipe 56 is connected. The feed pipe 56 leads into the interior of the protection vessel 50 and ends in a spray head 57. If the feed pipe 55 is in operation, cooling liquid is sucked off from the cooling liquid collecting vessel 53 via the immersion tube 54 and is pressed through the feed pipe 56 to the spray head 57 which sprays it to the surface of the absorber vessel 21, from which the cooling liquid trickles down and flows through the outflow 51 back into the cooling liquid collecting vessel 53.

Figure 5:
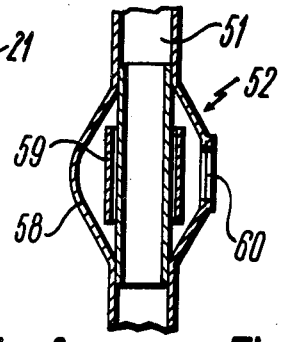
FIG. 5 is a longitudinal sectional schematic view of an indicator for use with the present invention.

The device commonly named as indicator is shown more detailed in FIG. 5. The indicator 52 comprises a vessel 58 through which the outflow 51 is conducted. Within the vessel 58 the outflow 51 is perforated. Outside this perforated tube a test folio 59 enveloping the perforated tube is disposed. The vessel 58 is provided with a window 60 through which the color of the test folio 59 may be observed. If the absorber vessel 21 is leaking, the refrigerant arrives in the cooling liquid and thus at the test folio 59, which then changes color which may be observed through the window 60.

While I have shown and described several embodiments in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. Refrigeration method comprising:

placing a compressor refrigerating system and an absorber refrigerating system having respective separate closed circuits in operative relationship with respect to one another such that a coolant from the compressor system is usable for cooling a refrigerant of the absorber system, and alternatingly operating the compressor and absorber systems to cool a common container with refrigerant store of the absorber system being replenished during operation of the compressor system by boiling out refrigerant from an absorber composition utilizing heat from coolant compressed and heated by a compressor of said compressor system.

2. Method according to claim 1, wherein said container is a transporter container which is subject to transport with movement of said container and to transport pauses, wherein said alternatingly operating includes operating said compressor system during transport pauses and operating said absorber system during transport, said operating of said absorber system being by the refrigerant store replenished during transport pauses without outside power being supplied.

3. Method according to claim 2, wherein said operating of said compressor system is only during said transport pauses, whereby an outside power source movable with said container is unnecessary.

4. Method according to claim 3, characterized in that prior to commencement of transport, the absorber composition is cooled in the absorber vessel by at least one of liquid coolant supplied in bypassing relationship to an evaporator of the compressor refrigerating system with evaporation being effected in the absorber vessel and gaseous coolant emanating from the evaporator of the compressor refrigerating system.

5. Method according to claim 1, wherein gaseous coolant leaving an evaporator of said compressor system is used for cooling the refrigerant of the absorber system.

6. Method according to claim 1, characterized in that the refrigerant of said absorber system is passed in gaseous form to a condenser from an absorber vessel containing said absorber composition and then through a heat exchanger to a collector for liquid absorber refrigerant, and wherein gaseous coolant flowing from an evaporator to a compressor of the compressor system flows through the heat exchanger to cool the refrigerant.

7. Method according to claim 6, characterized in that the coolant which leaves the heat exchanger is passed through a cooling coil of the collector for the absorber refrigerant.

8. Method according to claim 1, characterized in that, during operation of said compressor system, liquid coolant of said compressor system is fed to a heat exchanger in bypassing relationship to an evaporator of the compressor system, the coolant being evaporated in the heat exchanger via an exchanger of heat with refrigerant of the absorber system.

9. Method according to claim 1, characterized in that the coolant compressed by the compressor and therefore heated is used directly for expelling the refrigerant from the absorber composition.

10. Method according to claim 1, characterized in that the absorber composition during the operation period of the absorber system is additionally cooled in an absorber vessel by a liquid coolant.

11. Method according to claim 10, characterized in that the cooling is designed as surface refrigeration of the vessel and that the liquid coolant is monitored downstream of the absorber vessel.

12. Refrigerating apparatus comprising:

a compressor refrigerating system including a compressor and compressor driving means for compressing a gaseous coolant, a compressor system condenser downstream of said compressor for liquefying the coolant, compressor system supply line means leading from said compressor system condenser to a compressor system pressure relief throttle, a compressor system evaporator connected to said compressor system throttle and disposed for cooling a space to be cooled, and a compressor system return line leading from said compressor system evaporator to a suction connection of the compressor, an absorber refrigerating system including an absorber vessel for housing an absorber composition containing a refrigerant, an absorber system condenser connected by a gas line with said absorber vessel, a collecting vessel for collecting liquid absorber refrigerent from said absorber system condenser, an absorber system pressure relief throttle disposed downstream of said collecting vessel, an absorber system evaporator connected to said absorber system throttle and disposed for cooling said space, and an absorber system return line leading from said absorber system evaporator to said absorber vessel, and a heat exchanger for exchanging heat between coolant flowing through said compressor system in said compressor system return line and refrigerant flowing through said absorber system between the absorber system condenser and the collecting vessel.

13. Apparatus according to claim 12, characterized in that a cooling coil is interposed in the compressor system between the heat exchanger and the suction connection of the compressor, said cooling coil being disposed in the collecting vessel for cooling absorber refrigerant therein.

14. Apparatus according to claim 12, characterized in that a feed connection of the heat exchanger for coolant is connected to an outlet connection of the compressor system evaporator by a line.

15. Apparatus according to claim 12, characterized in that a subsidiary line extends from a position intermediate said compressor system condenser and said compressor system evaporator for communicating a portion of the coolant flowing out of said compressor system condenser directly to said heat exchanger in bypassing relationship to said compressor system evaporator, and characterized in that switch-over means are provided for controlling the flow of coolant through said subsidiary line, said switch-over means being controlled by a thermostat.

16. Apparatus according to claim 15, characterized in that the thermostat is sensitive to one of the temperature of one of the compressor system coolant and absorber system refrigerant emerging from the heat exchanger and of the temperature of the absorber system refrigerant in the collecting vessel which is then controlled variable.

17. Apparatus according to claim 12, characterized in that a feed connection of the heat exchanger for coolant is connected to an outlet side of a pressure relieving element, and that means for supplying liquid coolant to said pressure relieving element are provided so that the heat exchanger serves as an evaporator for the coolant.

18. Apparatus according to claim 12, characterized in that a non-return valve is incorporated in the line between the absorber vessel and the absorber system condenser.

19. Apparatus according to claim 12, characterized in that a heating condenser is provided downstream of the pressure connection of the compressor and is constructed as a heat source for the absorber vessel, the heating condenser being constructed as a heat exchanger incorporated into the absorber vessel.

20. Apparatus according to claim 19, characterized in that multi-way valve means are provided for switching over heating and cooling circuits of the absorber vessel and in that means are provided for switching the multi-way valve means over a function of one of time and the pressure obtaining in the absorber vessel.

21. Apparatus according to claim 12, characterized in that the absorber composition is held in the absorber vessel on superposed annular filters and in that a heat exchanger incorporated into the absorber vessel is constructed as a central spiral tube extending through the annular filters.

22. Apparatus according to claim 20, characterized in that means are provided for selectively connecting the spiral tube between the pressure connection of the compressor and the compressor system condenser, and between one of the compressor system condenser and compressor system evaporator and the suction connection of the compressor.

23. Apparatus according to claim 21, characterized in that the filters are connected in readily heat-conductive manner to the spiral tube, the filters being attached to a central carrier so that they can be removed from and replaced in the absorber vessel together with the carrier and the absorber composition.

24. Apparatus according to claim 21, characterized in that in addition a cooling apparatus is incorporated to which the filters are connected in readily heat-conductive manner.

25. Apparatus according to claim 12, characterized in that a cooling coil is built into the absorber vessel, and in that means are provided for selectively connecting said cooling coil between the suction connection of the compressor and the compressor system evaporator or the compressor system condenser.

26. Apparatus according to claim 12, characterized in that the absorber vessel is provided with an additional cooling apparatus connected to a liquid coolant store, and that the cooling apparatus is designed as surface refrigeration of the absorber vessel, an indicator for refrigerants being inserted into the flow of the liquid coolant downstream of the absorber vessel.

27. Apparatus according to claim 12, characterized by its use in the case of a transportable refrigerating container forming said space, means for operating the compressor refrigerating system during transport pauses and charging the absorber system, the absorber system taking over the work of refrigeration during transport with a non-operating compressor system.

* * * * *